US009893448B2

(12) United States Patent
Mashima et al.

(10) Patent No.: US 9,893,448 B2
(45) Date of Patent: Feb. 13, 2018

(54) ELECTRICAL CONNECTOR HAVING A SHELL PLATE WITH AN INTERMEDIATE CONNECTING PORTION JOINED TO A WIRING BOARD

(71) Applicant: DAI-ICHI SEIKO CO., LTD., Kyoto-shi (JP)

(72) Inventors: Hiroki Mashima, Fukuoka (JP); Tomohiro Ogino, Fukuoka (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 15/343,873

(22) Filed: Nov. 4, 2016

(65) Prior Publication Data

US 2017/0141499 A1 May 18, 2017

(30) Foreign Application Priority Data

Nov. 18, 2015 (JP) ..... 2015-226056

(51) Int. Cl.
*H01R 9/03* (2006.01)
*H01R 12/77* (2011.01)
(Continued)

(52) U.S. Cl.
CPC ..... *H01R 12/774* (2013.01); *H01R 12/59* (2013.01); *H01R 12/75* (2013.01); *H01R 13/62938* (2013.01); *H01R 13/6582* (2013.01)

(58) Field of Classification Search
CPC ..... H01R 12/59; H01R 12/62; H01R 12/75; H01R 12/774; H01R 13/6271;
(Continued)

(56) References Cited

U.S. PATENT DOCUMENTS 7,192,297 B1 * 3/2007 Wu ..... H01R 12/592 439/353
7,217,158 B2 * 5/2007 Shimizu ..... H01R 23/68 439/607.23
(Continued)

FOREIGN PATENT DOCUMENTS

JP 2005-332749 A 12/2005
JP 2006-172824 6/2006
(Continued)

OTHER PUBLICATIONS

English translation of Japanese office action dated Jul. 4, 2017 for JP2015226056, 3 pages.*
(Continued)

*Primary Examiner* — Chandrika Prasad
(74) *Attorney, Agent, or Firm* — Oblon, McClelland, Maier & Neustadt, L.L.P.

(57) ABSTRACT

The contact pressure of a contact member with respect to a connection target can be prevented well from being reduced by a simple configuration. An electrically-conductive shell covering a surface of an insulating housing opposed to a surface facing a wiring board is provided with an intermediate connecting portion extended from a position in the vicinity of a fixed base portion of the contact member toward the wiring board, and the intermediate connecting portion is joined with the wiring board. By virtue of this, deformation such as warpage of the insulating housing and the electrically-conductive shell upon insertion of the connection target is suppressed by retaining force of the intermediate connecting portion, and reduction in the contact pressure of the contact member with respect to the connection target is configured to be prevented.

5 Claims, 15 Drawing Sheets

(51) Int. Cl.
*H01R 13/629* (2006.01)
*H01R 12/59* (2011.01)
*H01R 12/75* (2011.01)
*H01R 13/6582* (2011.01)

(58) Field of Classification Search
CPC ..... H01R 13/6275; H01R 13/62933; H01R 13/62938; H01R 13/6392; H01R 13/6582; H01R 13/721
USPC ..... 439/157, 352, 607.49, 607.01–607.54, 439/629, 370
See application file for complete search history.

(56) References Cited

U.S. PATENT DOCUMENTS 7,934,957 B1 5/2011 Nakajima et al.
8,721,366 B2 * 5/2014 Yamaji ..... H01R 12/79 439/607.4
2003/0104726 A1 * 6/2003 Masumoto ..... H01R 23/6873 439/607.01
2006/0194475 A1 * 8/2006 Miyazaki ..... H01R 9/0527 439/578
2007/0072463 A1 3/2007 Suzuki et al.
2008/0220644 A1 9/2008 Yamada et al.
2010/0216342 A1 * 8/2010 Lin ..... H01R 4/023 439/607.49
2011/0151708 A1 * 6/2011 Kaneko ..... H01R 13/65802 439/404
2012/0164882 A1 * 6/2012 Ozeki ..... H01R 12/772 439/607.46
2013/0196546 A1 * 8/2013 Yamaji ..... H01R 13/6582 439/629
2015/0236457 A1 * 8/2015 Hsu ..... H01R 13/6582 439/607.12

FOREIGN PATENT DOCUMENTS

JP 2010-170843 8/2010
JP 2011-159598 8/2011
JP 2013-41679 2/2013
JP 2013-161540 8/2013
TW 201626658 A 7/2016

OTHER PUBLICATIONS

Extended Search Report dated Mar. 13, 2017 in European Patent Application No. 16198059.4.
Japanese Office Action dated Jul. 4, 2017 in Japanese Patent Application No. 2015-226056.
Taiwanese Office Action dated Sep. 13, 2017 in Taiwanese Application No. 105134277 (5 pages).

* cited by examiner

ELECTRICAL CONNECTOR HAVING A SHELL PLATE WITH AN INTERMEDIATE CONNECTING PORTION JOINED TO A WIRING BOARD

BACKGROUND OF THE INVENTION

Field of the Invention

The present invention relates to an electric connector configured to connect a connection target such as a counterpart connector to a wiring board.

Description of Related Art

Generally, in various electric devices, etc., transmitting electric signals, which are transmitted through various signal transmission media, to electronic circuits provided in a printed wiring board side via an electric connector mounted on the printed wiring board is widely carried out. More specifically, to an electric connector mounted on such a printed wiring board, another electric connector or a plate-shaped signal transmission medium such as a flexible printed circuit (FPC) or a flexible flat cable (FFC) serving as a connection target thereof to which a terminal part of a signal transmission medium is coupled is inserted, and a signal circuit is formed when the connection target like this is caused to be in a mated state.

The connection target consisting of the plate-shaped signal transmission medium like these or another electric connector is inserted from an insertion opening provided in a first end surface of the electric connector toward inner-side mating space, and electrode portions (contact-point portions) provided in the connection target are brought into contact with contact-point portions of contact members. When the connection target is inserted in such a manner, elastic beam portions of the contact members are elastically displaced so as to be lifted upward, and the contact-point portions of the contact members are brought into a pressure-contact state with respect to the electrode portions (contact-point portions) of the connection target by the elastic force generated based on the displacement so that electric connections are maintained.

However, along with recent reduction in the size/height of electronic devices, there is a tendency that an insulating housing of the electric connector is set to have a thin thickness. Under such circumstances, when the elastic beam portions of the contact members are elastically displaced so as to be lifted upward by the connection target inserted in the insulating housing, an upper wall portion of the insulating housing integrally formed from the part retaining the contact members is deformed so as to be warped upward particularly in the part constituting the mating space of the connection target. As a result, reduction in the contact pressures of the contact members with respect to the connection target may be caused. Countermeasures against the contact pressure reduction of the contact members like this are important for maintaining the reliability of the electric connector.

The inventors of this application disclose prior document of the present invention below.

[Patent Document 1] Japanese Patent Application Laid-Open No. 2013-161540

SUMMARY OF THE INVENTION

Therefore, it is an object of the present invention to provide an electric connector configured to be able to well prevent reduction in the contact pressure of a contact member with respect to a connection target by a simple configuration.

The invention according to a first aspect for achieving the above described object employs a configuration of an electric connector having: an insulating housing configured to form, in a first surface, an insertion opening to which a connection target is inserted and to house, in mating space, the connection target inserted from the insertion opening toward a second surface opposed to the first surface; a plurality of contact members attached in the insulating housing so as to form multipolar shapes; and an electrically-conductive shell attached in a state in which the electrically-conductive shell is covering an outer surface of the insulating housing; the contact member having a fixed base portion retained by the insulating housing, an elastic beam portion extended from the fixed base portion toward the first surface and disposed in an elastically displaceable state in the mating space, and a board connecting portion extended from the fixed base portion toward the second surface and joined with a wiring board; while the electrically-conductive shell having a first shell plate covering at least part of a surface of the insulating housing opposed to a surface facing the wiring board; the electric connector, wherein the first shell plate of the electrically-conductive shell is integrally provided with an intermediate connecting portion joined with the wiring board; and the intermediate connecting portion is formed in a state in which the intermediate connecting portion is extended from a position close to the first surface or a position close to the second surface with respect to the fixed base portion of the contact member toward the wiring board.

According to the invention according to the first aspect provided with such a configuration, when the connection target is inserted into the mating space, deformation of the insulating housing and the electrically-conductive shell caused along with elastic displacement of the contact members is suppressed by the retaining force of the intermediate connecting portion, and the contact pressures of the contact members with respect to the connection target are prevented from being reduced.

Moreover, according to the invention according to a second aspect, it is desired that the intermediate connecting portion be configured to be in a state in which the intermediate connecting portion is joined with a ground electrically-conductive path formed on the wiring board.

According to the invention according to the second aspect provided with such a configuration, an advantage that ground resistance is reduced is obtained since the number of ground contact-point portions is increased by the amount of the provided intermediate connecting portion.

Herein, according to the invention according to a third aspect, it is desired that the intermediate connecting portion be formed in a part between an edge portion forming the first surface of the insulating housing and an edge portion forming the second surface.

Moreover, according to the invention according to a fourth aspect, it is desired that the insulating housing be provided with a housing recessed portion housing the intermediate connecting portion; and the housing recessed portion be formed in a cut-out state from an edge forming the first surface of the insulating housing toward the second surface.

According to the invention according to the fourth aspect provided with such a configuration, attachment of the electrically-conductive shell with respect to the insulating housing is smoothly carried out without being disrupted by the intermediate connecting portion.

Moreover, according to the invention according to claim 5, the electrically-conductive shell can have a second shell plate disposed at the surface facing the wiring board; and, in the second shell plate, a shell recessed portion housing the intermediate connecting portion can be formed in a cut-out state from an edge of the second shell plate in a side of the second surface toward the first surface.

As described above, the present invention is configured to suppress the deformation such as warpage of the insulating housing and the electrically conductive shell upon insertion of the connection target by the retaining force of the intermediate connecting portion and prevent reduction in the contact pressures of the contact members with respect to the connection target by providing the electrically-conductive shell, which covers the surface of the insulating housing opposed to the surface facing the wiring board, with the intermediate connecting portion extending from the position in the vicinity of the fixed base portion of the contact member toward the wiring board and by joining the intermediate connecting portion with the wiring board. Therefore, by the simple configuration, reduction in the contact pressures of the contact members with respect to the connection target can be prevented well, and reliability of the electric connector can be significantly increased at low cost.

DETAILED DESCRIPTION OF THE PREFERRED EMBODIMENTS

Figure 1:
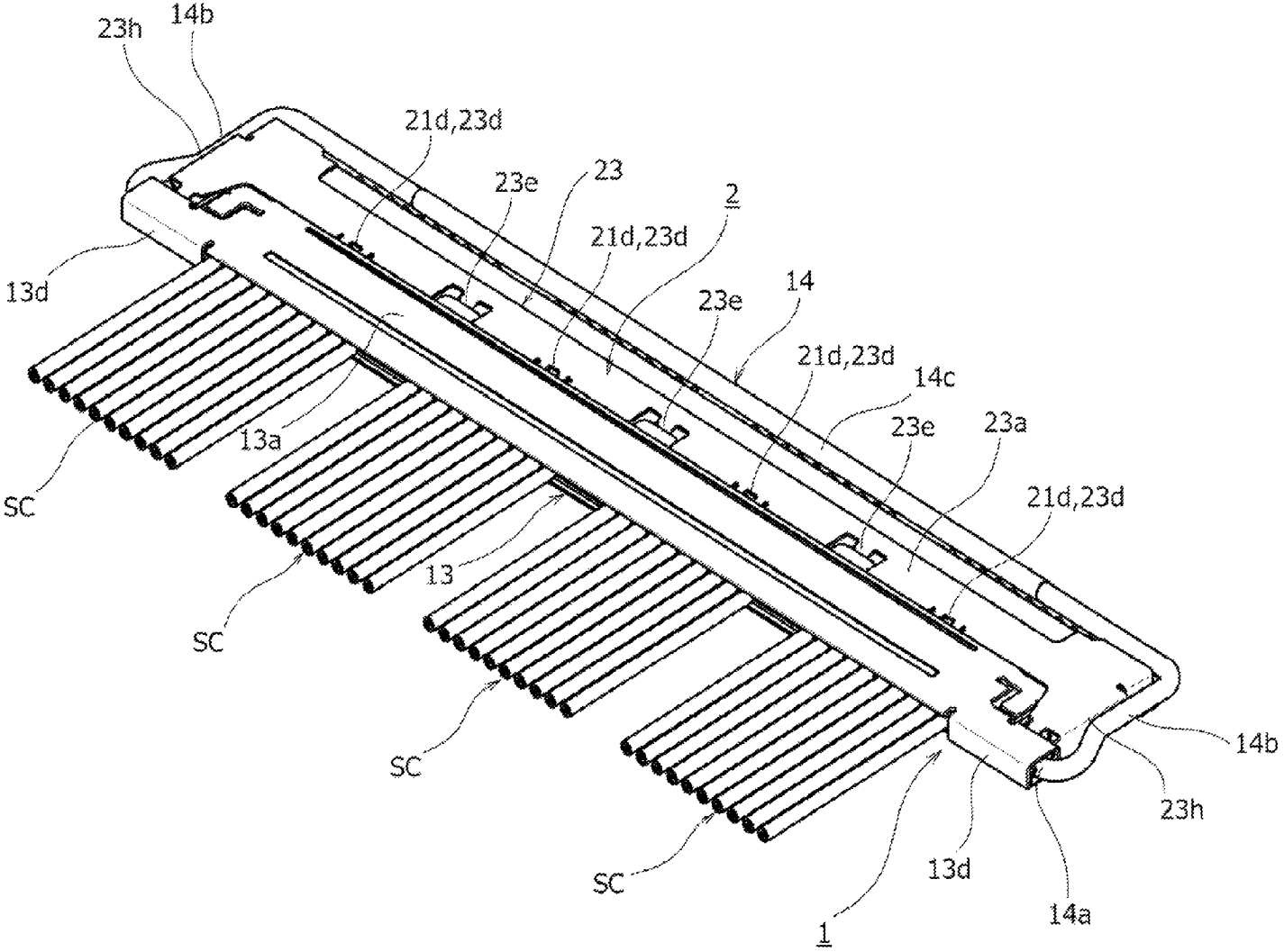
FIG. 1 is an external perspective explanatory view showing a state in which a plug connector and a receptacle connector constituting an electric connector device according to an embodiment of the present invention are mated with each other.
Figure 2:
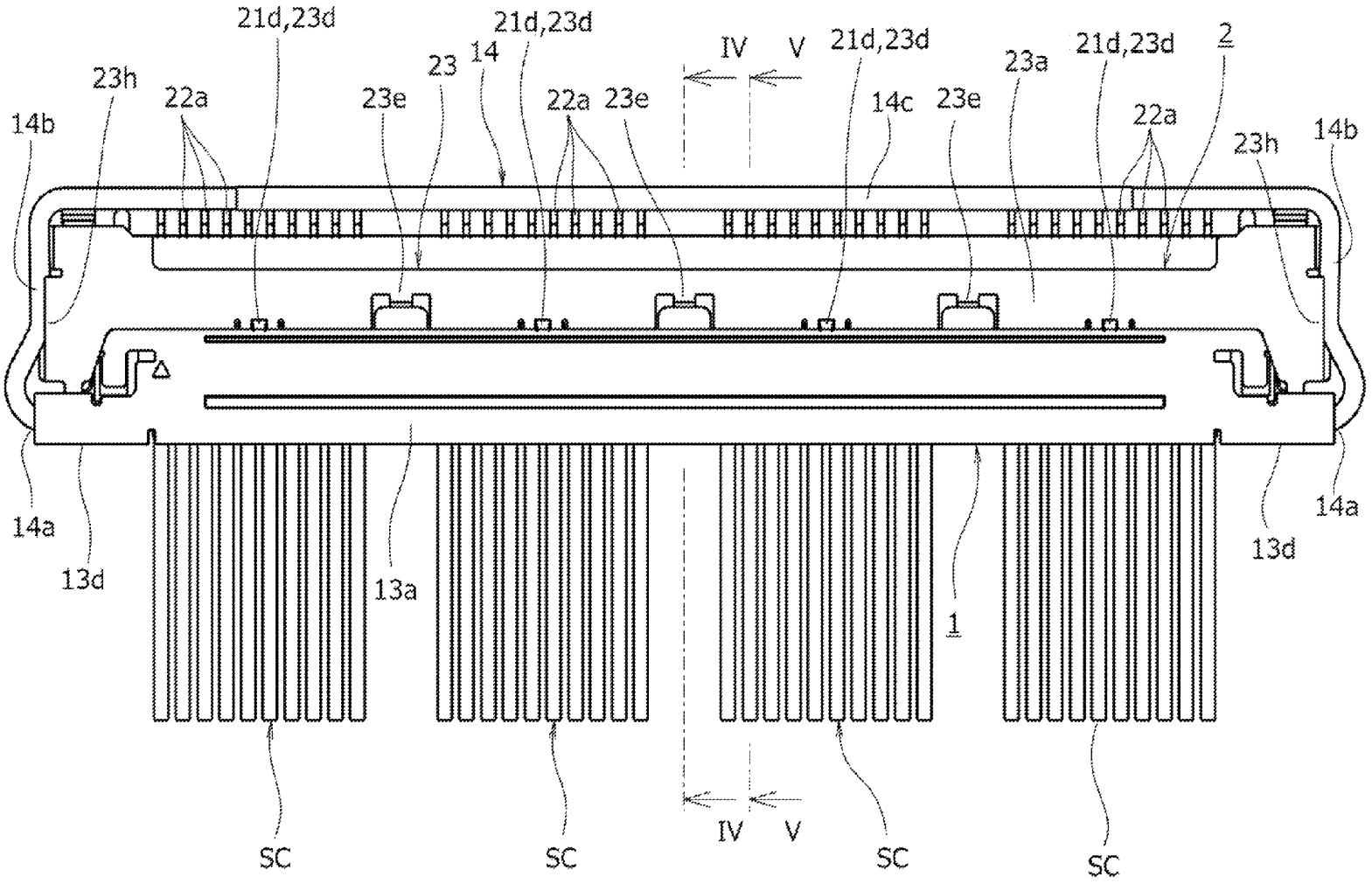
FIG. 2 is a plan explanatory view of the electric connector device in the mated state shown in FIG. 1.
Figure 3:
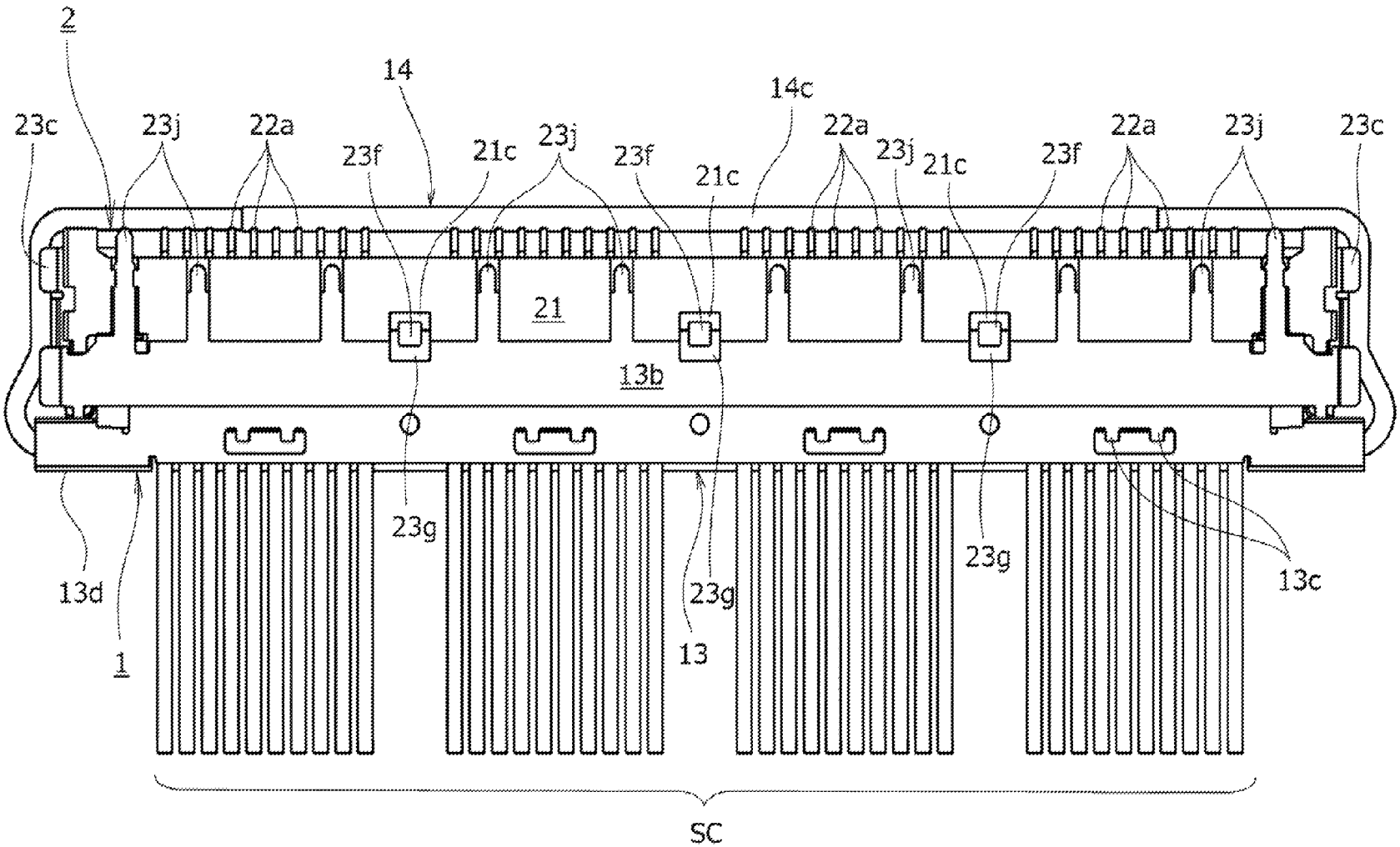
FIG. 3 is a bottom explanatory view of the electric connector device in the mated state shown in FIG. 1.

Hereinafter, an embodiment of a case in which the present invention is applied to an electric connector that connects a plurality of coaxial cables to a printed wiring board side will be described in detail based on drawings.

[Outline of Entire Structure of Electric Connector Device]

First, an electric connector device according to the embodiment of the present invention shown in FIG. 1 to FIG. 5 is a horizontal-mating-type electric connector device provided with: a plug connector 1 serving as a counterpart connector to which terminal parts of coaxial cables SC constituting signal transmission media are connected and a receptacle connector 2 according to the present invention mounted on a printed wiring board (illustration omitted). After the plug connector 1 is disposed so as to be opposed, in an approximately horizontal direction, to the receptacle connector 2, which is mounted on the printed wiring board, the plug connector 1 is horizontally moved in the direction approximately parallel to the surface of the printed wiring board (extending direction of the printed wiring board) so as to approach the receptacle connector 2 side. As a result, a horizontally-long-shaped one edge part (electrode part) of the plug connector 1 is inserted through an insertion opening, which is provided in the receptacle connector 2 so as to similarly form a laterally long shape, and, as a result, the electric connectors 1 and 2 are brought into a mutually mated state.

In this manner, in the present embodiment, the direction of inserting the plug connector 1 serving as the counterpart connector to the receptacle connector 2 and the direction of removing the plug connector 1 in the opposite direction thereof are configured to be the directions approximately parallel to the direction in which the surface of the printed wiring board is extending. Hereinafter, the extending direction of the surface of the printed wiring board will be referred to as "horizontal direction", and the direction perpendicular to the surface of the printed wiring board will be referred to as "top-bottom direction".

Singularly in the plug connector 1, the direction of inserting the plug connector 1 to the receptacle connector 2 will be referred to as "forward direction", the direction of removing the plug connector 1 in the opposite direction thereof will be referred to as "backward direction", an inserting-side distal end part of the plug connector 1 will be referred to as "front end part", and a second part thereof opposed thereto in the opposite side will be referred to "rear end part". Furthermore, in the receptacle connector 2, the direction of removing the plug connector 1 from the receptacle connector 2 will be referred to as "forward direction", the opposite direction thereof will be referred to as "backward direction", an end part in the side including "front end surface (first surface)" provided with the insertion opening to which the plug connector 1 serving as the counterpart connector is to be inserted will be referred to as "front end part", and a part including "rear end surface (second surface)" opposed to the opposite side thereof will be referred to as "rear end part".

The electric connectors, i.e., the plug connector 1 and the receptacle connector 2 constituting the electric connector device like this are respectively provided with insulating housings 11 and 21 composed of insulating members such as resin formed in laterally long shapes as shown in FIG. 6 to FIG. 15. Hereinafter, the longitudinal direction of the insulating housings 11 and 21 (left-right direction in FIG. 2) will be referred to as "connector longitudinal direction".

In each of the above described insulating housings 11 and 21, a plurality of electrically-conductive contact members (electrically-conductive terminals) 12 or 22 having the same shapes are arranged along the connector longitudinal direction (left-right direction in FIG. 2) so as to form multipolar shapes at appropriate pitch intervals. These electrically-conductive contact members 12 and 22 are disposed in a state in which they are divided into a plurality of blocks (4 blocks) in the connector longitudinal direction, and, in the part between the mutually adjacent blocks, a spatial part is formed across a width corresponding to three times the pitch interval of the electrically-conductive contact members 12 or 22 in each block.

The terminal parts of the plurality of coaxial cables SC, which are arranged so as to be juxtaposed in multipolar shapes along the connector longitudinal direction, are coupled to the rear end part of the plug connector 1 among the electric connectors 1 and 2. The disposed positions of the coaxial cables SC in the connector longitudinal direction are set to correspond to the above described electrically-conductive contact members 12, and the coaxial cables SC are disposed to be divided into a plurality of blocks (4 blocks) in the connector longitudinal direction as well as the electrically-conductive contact members 12.

At the terminal part of each of the coaxial cables SC, a coating material is peeled off, thereby exposing a cable central conductor (signal wire) SCa and a cable external conductor (shield wire) SCb so as to form a coaxial shape. When the cable central conductor SCa disposed so as to extend along the central axis of the coaxial cable SC is connected to the electrically-conductive contact member 12, which is for signal transmission, a signal circuit is formed. The connection structure of the cable central conductor SCa will be described later in detail.

The cable external conductors SCb disposed so as to concentrically surround the outer peripheral sides of the above described cable conductors SCa are connected in common to a ground bar GB, which is composed of an electrically-conductive ground member extending in the connector longitudinal direction. The ground bar GB is formed by a slender band-shaped member or a block-shaped member extending in a long shape along the multipolar arrangement direction (connector longitudinal direction) of the above described coaxial cables SC, and the ground bar GB is collectively connected to the cable external conductors (shield wires) SCb of the coaxial cables SC by soldering, swaging, pressurized contact, or the like. The ground bar GB provided in this manner is electrically connected to a ground circuit formed on the printed wiring board via a later-described electrically-conductive shell of the receptacle connector 2.

[About Insulating Housing and Electrically-Conductive Contact Members of Plug Connector]

Herein, the insulating housing 11 provided in the plug connector 1 side is integrally provided with main-body supporting portions 11*a*, which are disposed in a front-rear-direction central region of the plug connector 1, and mating projection portions 11*b*, which are extending from the main-body supporting portions 11*a* toward the front side. The electrically-conductive contact members (plug-side contact members) 12 are buried by insert molding or retained by press-fitting in the upper surface side thereof from the main-body supporting portions 11*a* to the mating projection portions 11*b*. The electrically-conductive contact members 12 are extending approximately horizontally in a state in which the electrically-conductive contact members 12 are divided in the above described plurality of (4) blocks so as to be exposed to the upper side from the upper surface of the insulating housing 11.

The terminal part of the cable central conductor (signal wire) SCa of the coaxial cable SC is solder-joined to the rear end part of the electrically-conductive contact member provided in the plug connector 1 like this in a state in which the terminal part is abutting the part from the upper side. The solder joining of the cable central conductors SCa with the electrically-conductive contact members 12 can be collectively carried out with respect to a plurality of locations in the multipolar arrangement direction, and the plurality of coaxial cables SC can be efficiently coupled by such collective solder joining.

On the other hand, terminal electrode portions 12*a*, which constitute the front-side parts of the electrically-conductive contact members (plug-side contact members) 12 are disposed on the upper surfaces of the mating projection portions 11*b*, which are provided in the front end parts of the insulating housing (connector main-body portion) 11 as described above, so as to form multipolar-shaped exposed electrodes. Each of the terminal electrode portions 12*a* constituting the front-side extending part of the electrically-conductive contact member 12 is configured to abut the electrically-conductive contact member (receptacle-side contact member) 22, which is provided in the receptacle connector 2, from the lower side when the plug connector 1 is mated with the receptacle connector 2, and, as a result, a signal transmission circuit is formed. Note that part of the plurality of electrically-conductive contact members 12 and 22 can be formed for ground connections.

[About Insulating Housing and Electrically-Conductive Contact Members of Receptacle Connector]

On the other hand, at the front-side end surface of the insulating housing (connector main-body portion) 21 in the receptacle connector 2 side, in other words, at the "first surface" in the present invention, the insertion opening 21*a* extending in a laterally long shape along the connector longitudinal direction is formed, and mating space 21*b* extending from the insertion opening 21*a* toward the rear side is formed so as to similarly form a laterally long shape. As described above, the mating projection portion 11*b* of the plug connector 1 serving as the counterpart connector is configured to be inserted and housed in the mating space 21*b* through the insertion opening 21*a* in the receptacle connector 2 side.

The electrically-conductive contact members (receptacle-side contact members) 22 attached to the insulating housing (connector main-body portion) 21 in the receptacle connector 2 side are disposed at the positions corresponding to the above described electrically-conductive contact members (plug-side contact members) 12 in the plug connector 1 side, and the electrically-conductive contact members 22 are arranged so as to form multipolar shapes in a state in which the electrically-conductive contact members 22 are divided in a plurality of blocks (4 blocks) in the connector longitudinal direction. When the electric connectors 1 and 2 are mated with each other, each of the electrically-conductive contact members 22 attached to the insulating housing 21 of the receptacle connector 2 elastically contacts the terminal electrode portion 12*a* of the electrically-conductive contact member 12 of the plug connector 1 side from the upper side and is brought into an electrically connected state.

In a rear end part of the electrically-conductive contact member (receptacle-side contact member) 22 (right-end-side part in FIG. 14 and FIG. 15), a board connecting leg portion 22*a* formed so as to extend along the surface of the printed wiring board (illustration omitted) is formed. In a state in which the board connecting leg portions 22*a* are placed on electrically-conductive signal paths or on electrically-conductive paths for ground connections on the above described printed wiring board in actual usage (in mounting), the board connecting leg portions 22*a* are subjected to, for example, collective solder joining.

Figure 14:
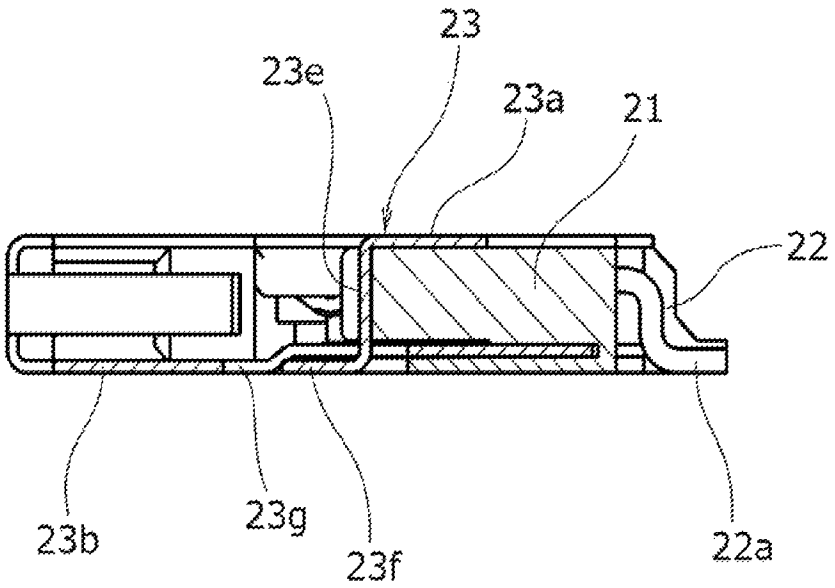
FIG. 14 is an enlarged transverse cross-sectional explanatory view along a line XIV-XIV in FIG. 10.
Figure 15:
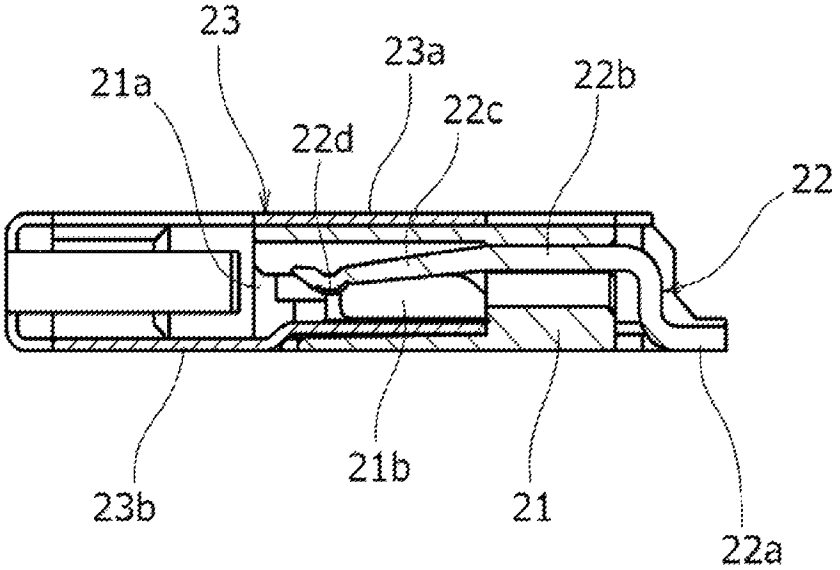
FIG. 15 is an enlarged transverse cross-sectional explanatory view along a line XV-XV in FIG. 10.

The electrically-conductive contact member (receptacle-side contact member) 22 in the present embodiment is configured to be bent upward from the above described board connecting leg portion 22*a* in the rear end side, be then extended so as to rise upward along the rear-side end surface (second surface) of the insulating housing 11, and be further bent and extended to the front side (left side in FIG. 14 and FIG. 15). More specifically, the part extending from the upper end of the part, which rises from the above described board connecting leg portion 22*a*, toward the front side (left side in FIG. 14 and FIG. 15) is formed into a fixed base portion 22*b* attached so as to be in a fixed state with respect to the insulating housing 11; and an elastic beam portion 22*c* is extending in a cantilever shape from the fixed base portion 22*b* toward the front side (first surface side).

The fixed base portion 22*b* constituting the base end part of the electrically-conductive contact member (receptacle-side contact member) 22 like this is retained in a fixed state by being subjected to press-fitting or insert molding with respect to the rear end part of the insulating housing 11, the above described board connecting leg portion 22*a* is continuously provided in the rear side of the fixed base portion 22*b*, and the elastic beam portion 22*c* is continuously provided in the front side of the fixed base portion 22*b*.

Among them, the elastic beam portion 22*c* is disposed in a state in which the elastic beam portion 22*c* is elastically displaceable in the top-bottom direction in the mating space 21*b* provided in the insulating housing 21. At the front-side distal-end part of each of the elastic beam portions 22*c*, a contact-point protruding portion 22*d* bulging in a chevron shape toward the lower side is provided. A lower-side tip portion of the contact-point protruding portion 22*d* provided in the elastic beam portion 22*c* of the electrically-conductive contact member 22 is configured to contact the terminal electrode portion 12*a* of the electrically-conductive contact member (plug-side contact member) 12 in the plug connector 1 side in a state in which the lower-side tip portion is elastically pressed thereagainst from the upper side when the plug connector 1 is mated with the receptacle connector 2. The electric connection between the above described contact-point portions 12*a* and 22*d* is configured to be maintained by such an elastic contact relation.

[About Electrically-Conductive Shell]

On the other hand, the outer surfaces of the insulating housings 11 and 21 provided in the plug connector 1 and the receptacle connector 2 are respectively covered by a plug-side electrically-conductive shell 13 and the receptacle-side electrically-conductive shell 23, which are formed by bending electrically-conductive thin-plate-shaped metal members into appropriate shapes. The plug-side electrically-conductive shell 13 and the receptacle-side electrically-conductive shell 23 are attached as shield members which carry out electromagnetic shielding by covering the signal transmission circuits and the ground circuits, which are formed in the electric connectors 1 and 2, from the outer side, and the plug-side electrically-conductive shell 13 and the receptacle-side electrically-conductive shell 23 are also the members which constitute part of the ground circuits.

[About Plug-Side Electrically-Conductive Shell]

Among them, the plug-side electrically-conductive shell 13 attached to the plug connector 1 side is formed by a mated body of a pair of upper/lower shell plates (first and second shell plates) sandwiching the insulating housing 11 from the top-bottom direction. When the upper shell plate (first shell plate) 13*a* and the lower shell plate (second shell plate) 13*b* are to be attached to the plug connector 1, as a previous process thereof, first, the ground bar (ground member) GB is brought into a state in which the ground bar GB is solder-joined with the terminal parts of the coaxial cables SC. Then, the lower shell plate (second shell plate) 13*b* constituting the lower half part of the above described plug-side electrically-conductive shell 13 is caused to cover the insulating housing 11 from the lower side, and the terminal parts of the coaxial cables SC, which are in the state in which the terminal parts thereof are solder-joined with the above described ground bar GB, are set so as to be placed on the surface of the insulating housing 11 covered by the lower shell plate (second shell plate) 13*b*. Then, the upper shell plate (first shell plate) 13*a* constituting the upper half part of the plug-side electrically-conductive shell 13 is attached to the insulating housing 11 so as to cover that from the upper side.

In the lower shell plate (second shell plate) 13*b* constituting the lower half part of the plug-side electrically-conductive shell 13 like this, a plurality of ground-connection tongue pieces 13*c* are formed along the multipolar arrangement direction (connector longitudinal direction) by cutout processing. The ground-connection tongue pieces 13*c* are cut and raised so as to form cantilever plate spring shapes projecting toward the space in the connector inner side, and the ground-connection tongue pieces 13*c* elastically contact or are solder-joined with the lower surface side of the above described ground bar GB.

Figure 4:
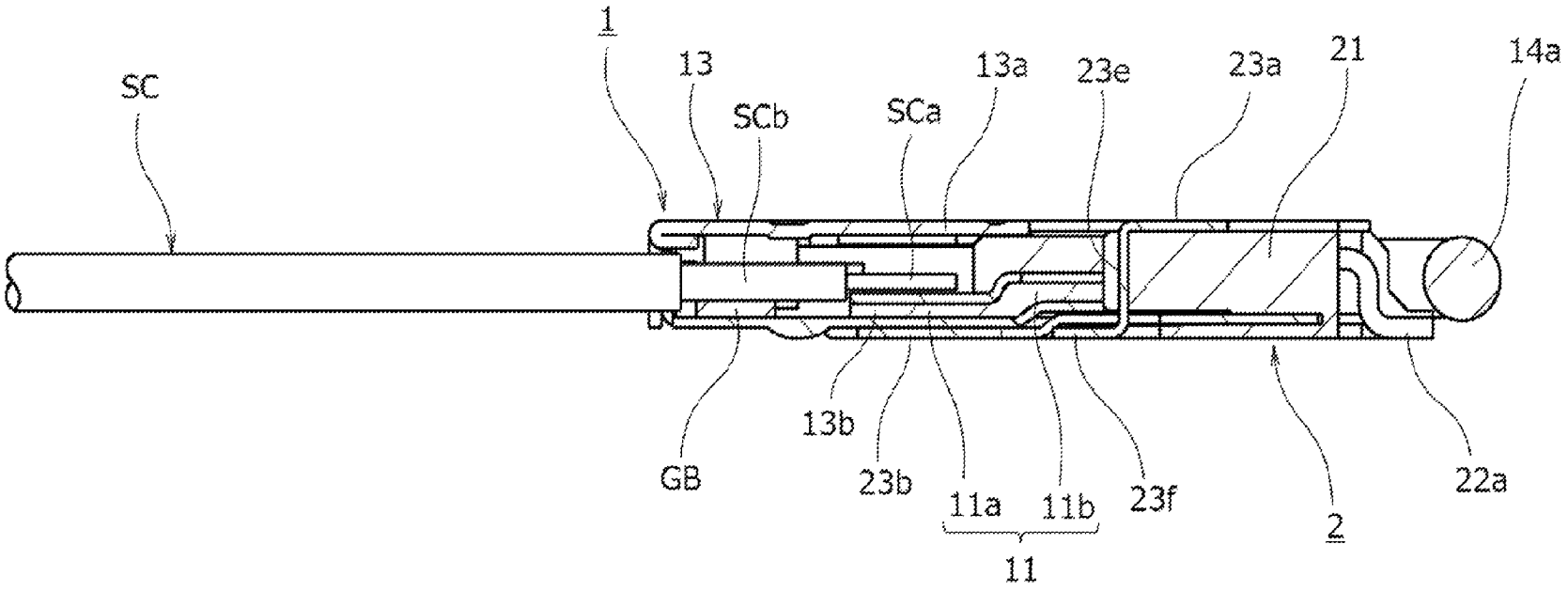
FIG. 4 is a transverse cross-sectional explanatory view along a line IV-IV in FIG. 2.
Figure 5:
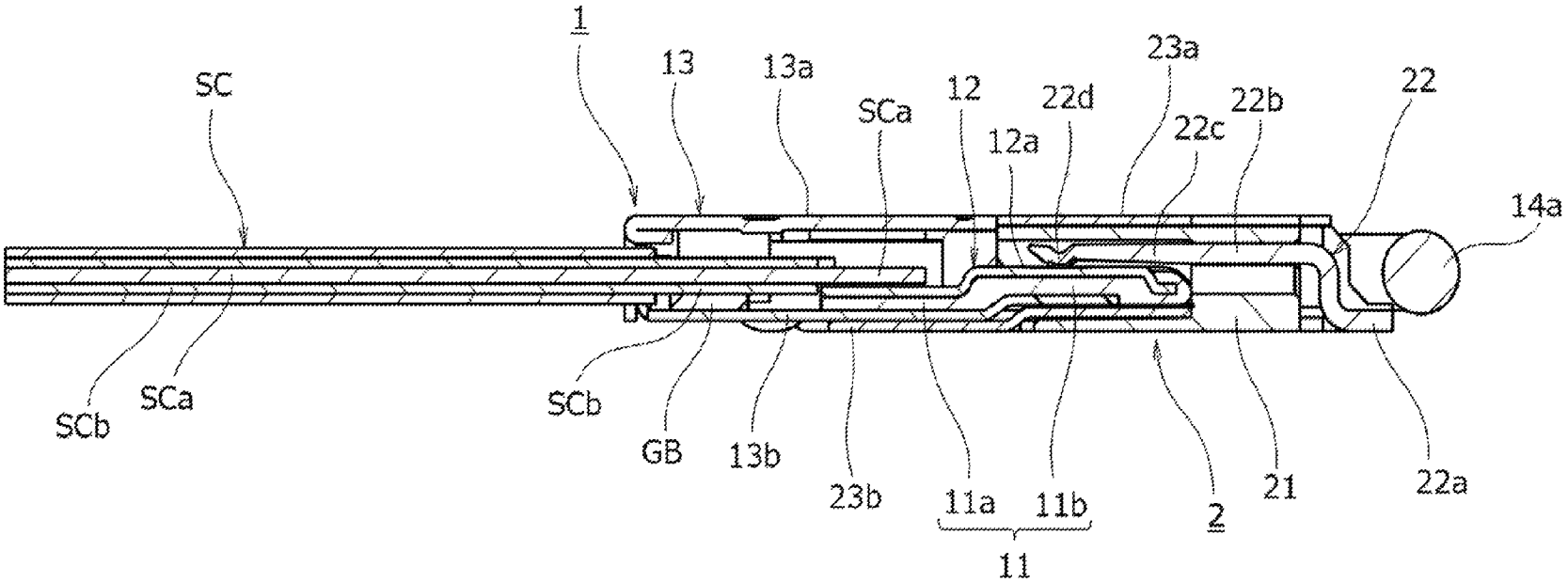
FIG. 5 is a transverse cross-sectional explanatory view along a line V-V in FIG. 2.
Figure 6:
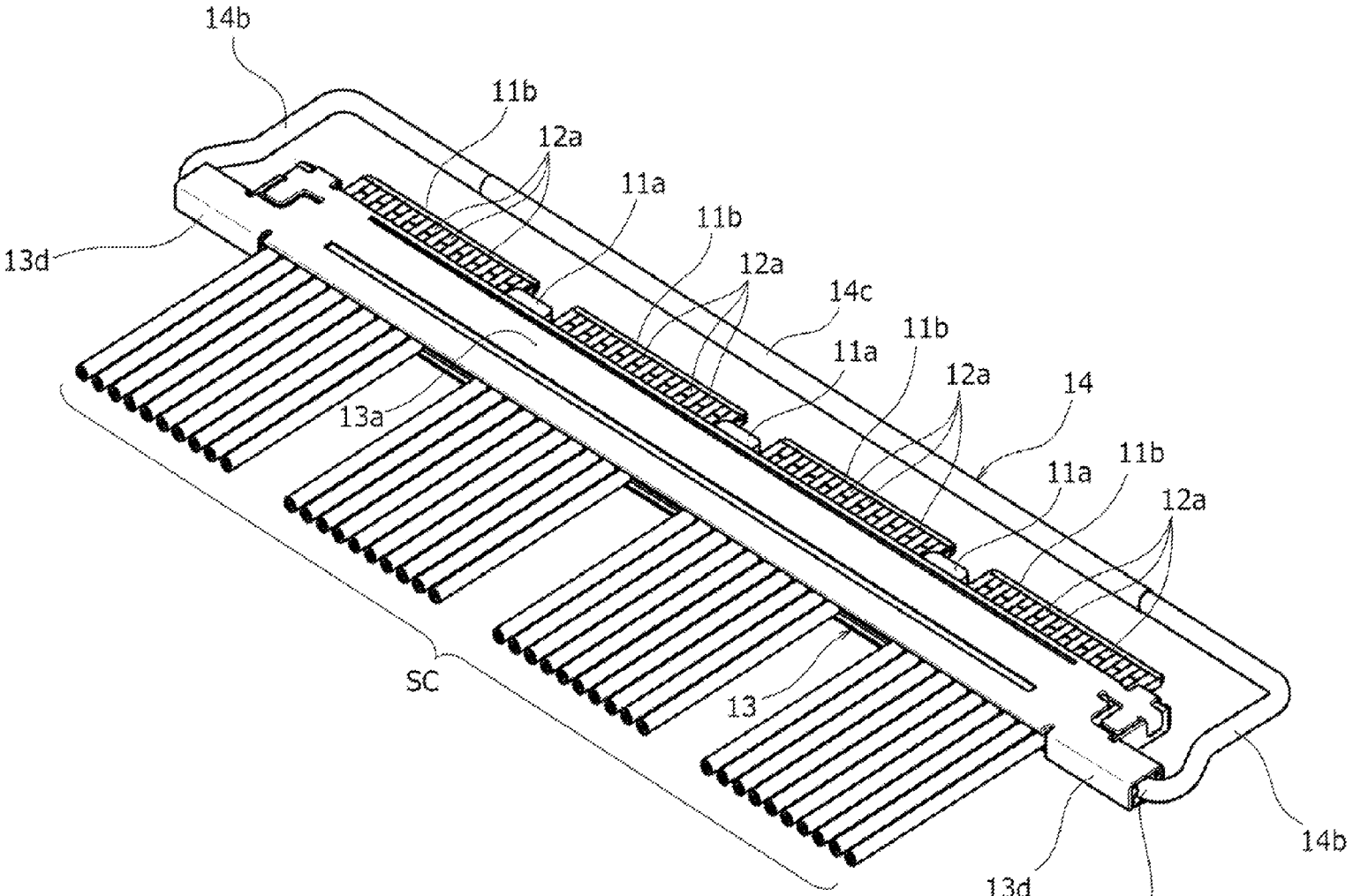
FIG. 6 is an external perspective explanatory view singularly showing the plug connector constituting the electric connector device in the mated state shown in FIG. 1 to FIG. 5.
Figure 7:
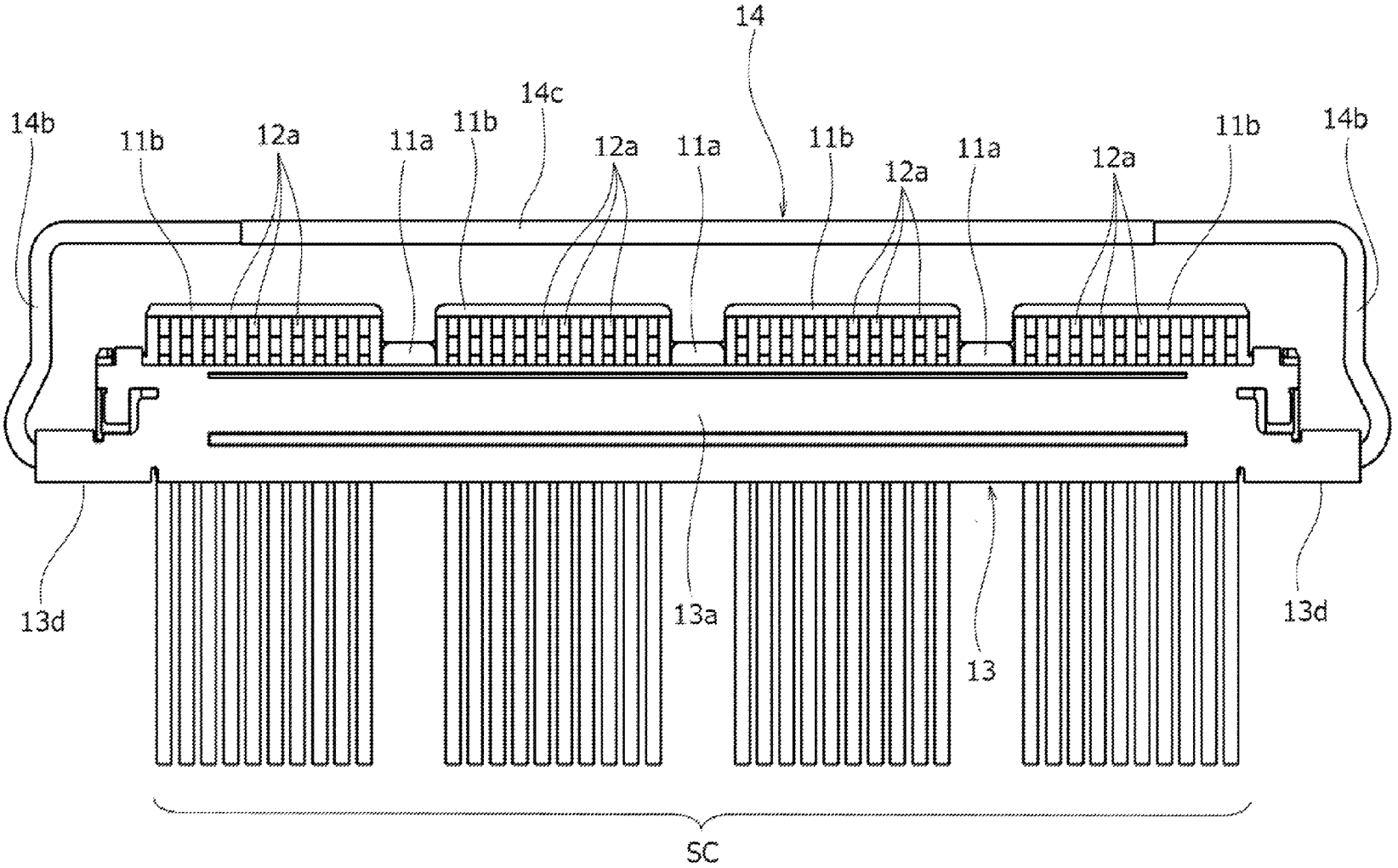
FIG. 7 is a plan explanatory view of the plug connector shown in FIG. 6.
Figure 8:
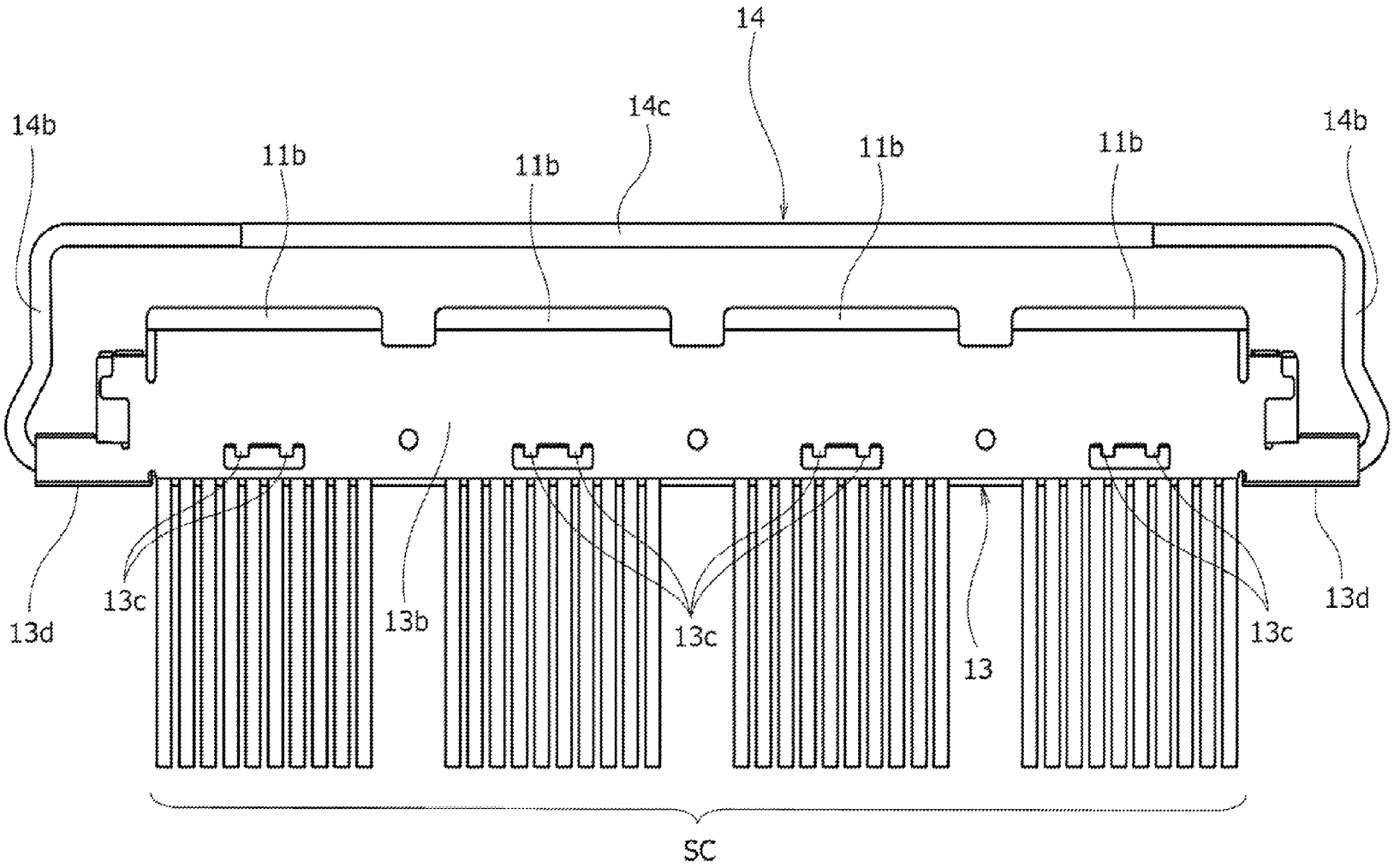
FIG. 8 is a bottom explanatory view of the plug connector shown in FIG. 6.
Figure 9:
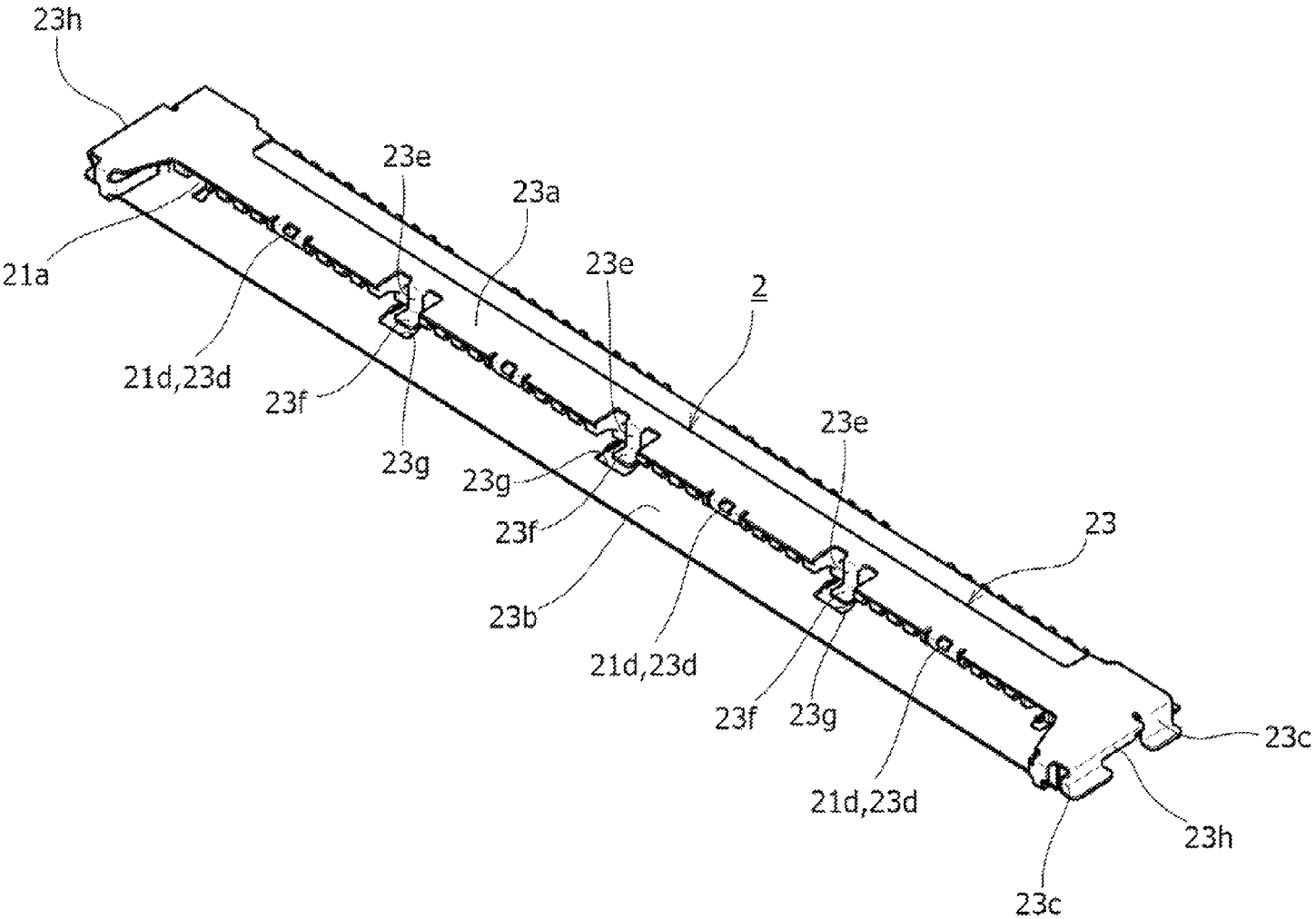
FIG. 9 is an external perspective explanatory view singularly showing the receptacle connector constituting the electric connector device in the mated state shown in FIG. 1 to FIG. 5.
Figure 10:
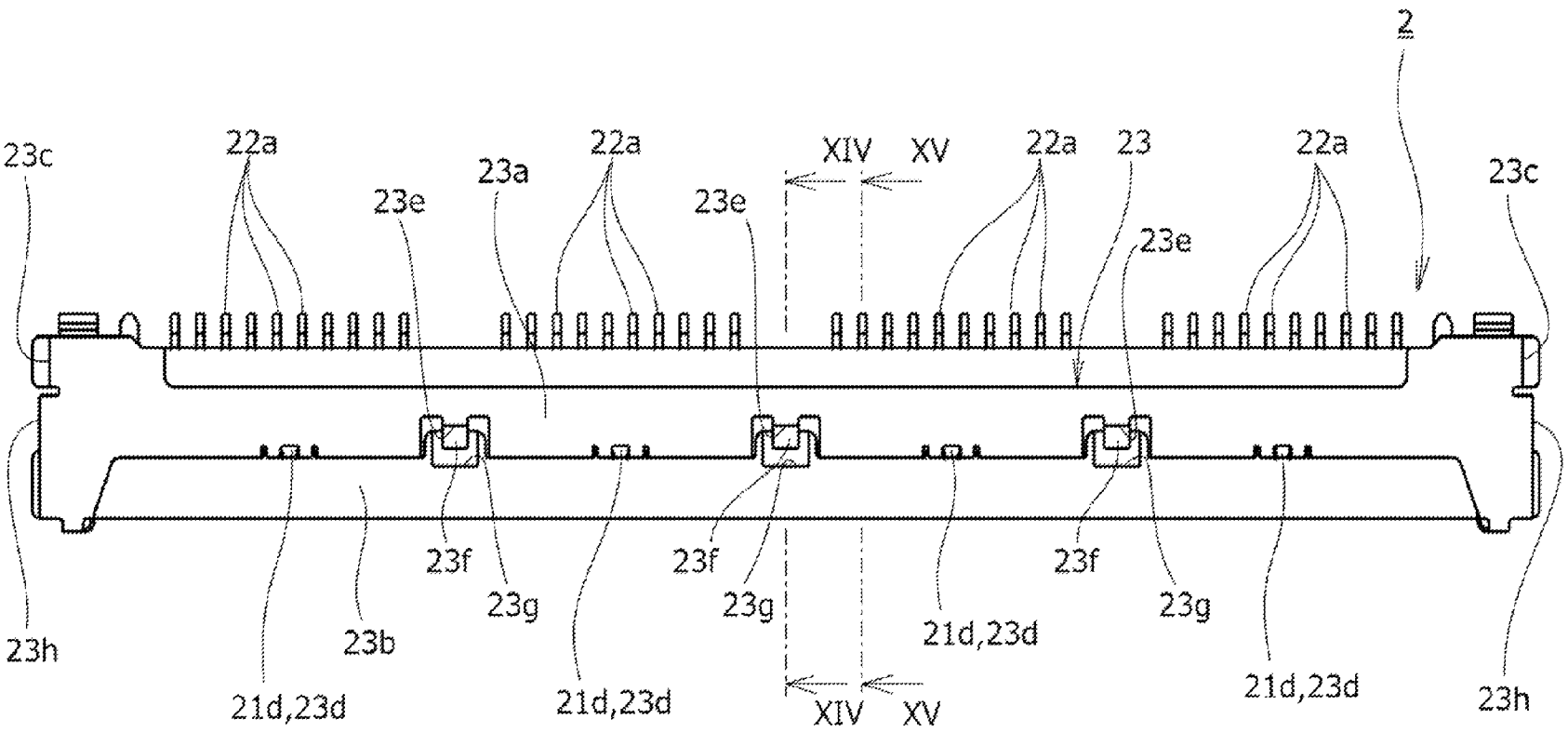
FIG. 10 is a plan explanatory view of the receptacle connector shown in FIG. 9.
Figure 11:
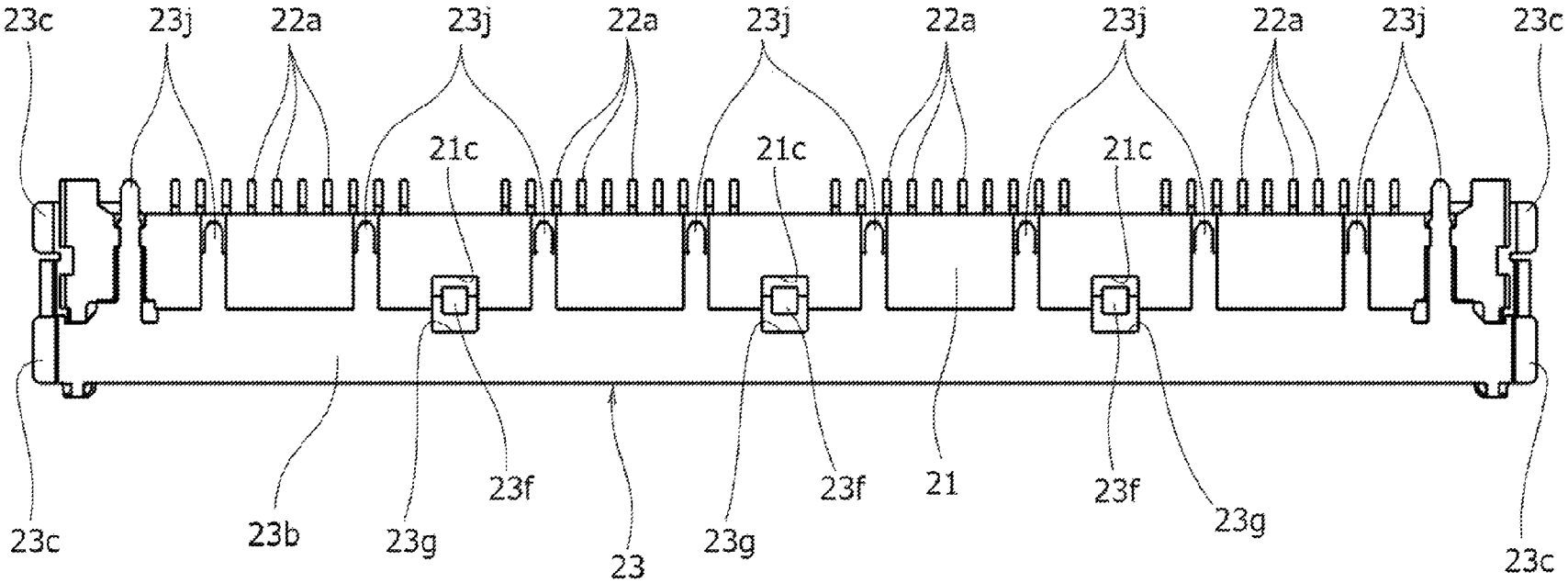
FIG. 11 is a bottom explanatory view of the receptacle connector shown in FIG. 9.
Figure 12:
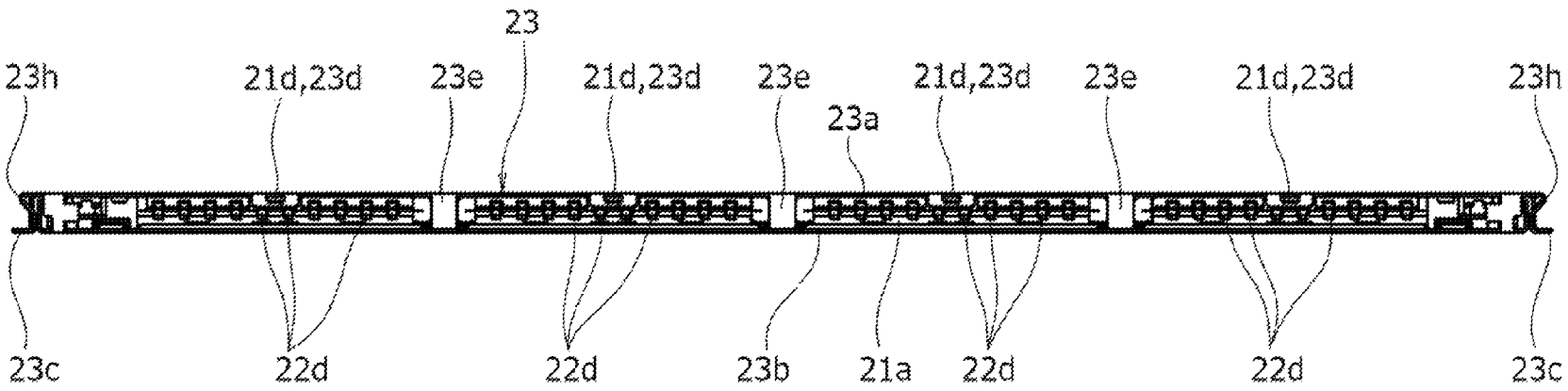
FIG. 12 is a front explanatory view of the receptacle connector shown in FIG. 9.
Figure 13:
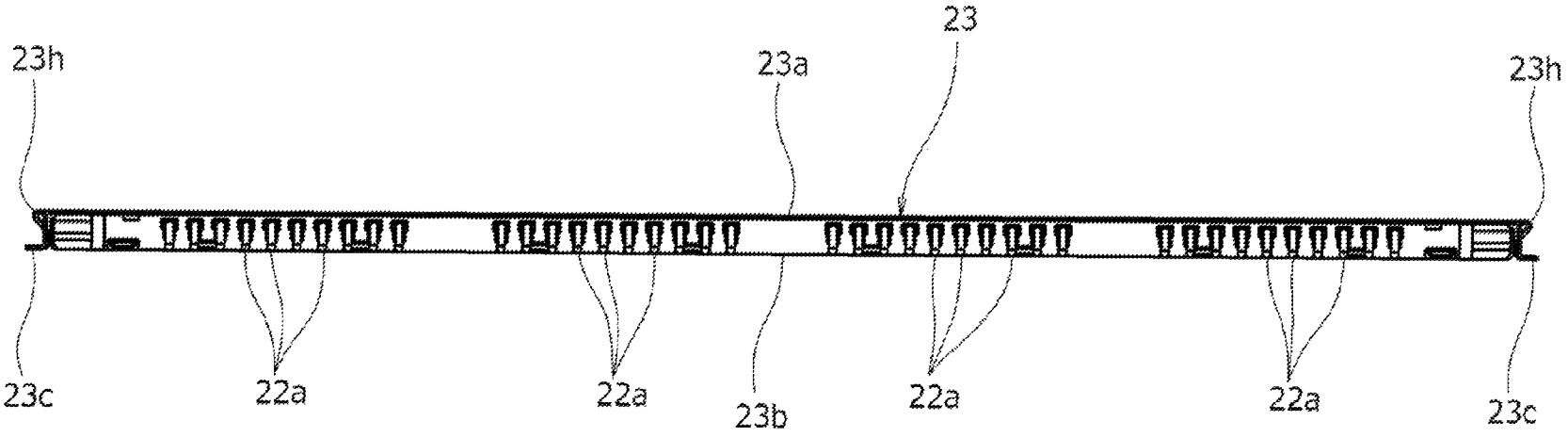
FIG. 13 is a back explanatory view of the receptacle connector shown in FIG. 9.

Then, particularly as shown in FIG. 4 and FIG. 5, in the state in which the plug connector 1 is mated with the receptacle connector 2 serving as the counterpart connector, the lower shell plate (second shell plate) 13*b* of the plug-side electrically-conductive shell 13 abuts a later-described lower shell plate (second shell plate) 23*b* of the receptacle-side electrically-conductive shell 23, which is attached to the receptacle connector 2, from the upper side, thereby forming the ground circuit (earth circuit).

[About Electrically-Conductive Shell of Receptacle Connector (Electrically-Conductive Shell)]

More specifically, the receptacle-side electrically-conductive shell 23 provided in the receptacle connector 2 is also formed by a mated body of a pair of upper/lower shell plates (first and second shell plates) 23*a* and 23*b* sandwiching the insulating housing 21 from the upper and lower sides. The upper shell plate (first shell plate) 23*a* and the lower shell plate (second shell plate) 23*b* constituting the receptacle-side electrically-conductive shell 23 is also formed by bent structures of thin-plate-shaped metal members having electric conductivity. At connector-longitudinal-direction both end parts of the upper shell plate (first shell plate) 23*a*, particularly as shown in FIG. 9 to FIG. 13, a pair of holddowns 23*c*, 23*c* are disposed so as to sandwich the insulating housing 21 from connector-longitudinal-direction both sides and so as to rise upward from the surface of the printed wiring board.

More specifically, the holddowns 23*c* and 23*c* are formed by being bent downward from the connector-longitudinal-direction both edge portions of the upper shell plate (first shell plate) 23*a* so as to form both lateral wall plates of the receptacle-side electrically-conductive shell 23, and each of front-rear-direction both side parts of the lower edge parts of the holddowns 23*c* is bent so as to extend toward the longitudinal-direction outer side and is formed into a board connecting portion. The board connecting portions thereof are solder-joined with the electrically-conductive paths for ground connections formed on the printed wiring board, thereby establishing electrical connections of ground circuits and firmly fixing the entire receptacle connector 2.

Herein, the above described upper shell plate (first shell plate) 23*a* is extending so as to form a planar ceiling plate along the outer surface of an upper wall portion which forms the mating space 21*b* of the insulating housing 21, and the lower shell plate (second shell plate) 23*b* is extending so as to form a planar bottom plate along the inner surface of a lower wall portion which forms the mating space 21*b* of the insulating housing 21. More specifically, the upper shell plate (first shell plate) 23*a* in the receptacle-side electrically-conductive shell 23 is configured to cover at least part of the surface of the outer surface of the insulating housing 21 that is opposed to the surface facing the printed wiring board, and a front edge part of the upper shell plate (first shell plate) 23*a* is in a disposition relation in which the front edge part at the position above the lower shell plate (second shell plate) 23*b* is extending in the connector longitudinal direction. A shell insertion opening extending in a laterally long shape is formed in the part between the front edge part of the upper shell plate (first shell plate) 23*a* and the lower shell plate (second shell plate) 23*b*.

The shell insertion opening provided in the receptacle-side electrically-conductive shell 23 is in a disposition relation in which the above described insertion opening 21*a* of the insulating housing 21 side is exposed toward the front side. The front edge part of the upper shell plate (first shell plate) 23*a* is disposed so as to be overlapped, from the upper side, with a front edge portion of an upper wall portion forming the insertion opening 21*a* of the insulating housing 21 side in a state in which they are aligned in the front-rear direction. As described above, the mating projection portions 11*b* of the plug connector 1 are configured to be inserted in the mating space 21*b*, which is formed in the receptacle connector 2, through the insertion opening 21*a* of the insulating housing 21, which is caused to be in an exposed state toward the front side by the shell insertion opening of the receptacle-side electrically-conductive shell 23.

As described above, the front edge part of the upper shell plate (first shell plate) 23*a* constituting the receptacle-side electrically-conductive shell 23 is overlapped with the front edge portion of the upper wall portion which forms the insertion opening 21*a* of the insulating housing 21 side in the aligned state from the upper side; wherein, in the front edge part of the upper shell plate (first shell plate) 23*a* of the receptacle-side electrically-conductive shell 23, a plurality of (four) latch hole portions 23*d* are formed at certain intervals in the longitudinal direction. Each of the latch hole portions 23*d* is penetrating and formed into a claw-shaped part which is part of the front edge part of the upper shell plate (first shell plate) 23*a* bent in a curved shape toward the inner side of the insertion opening 21*a* of the insulating housing 21.

On the other hand, corresponding to the latch hole portions 23*d* of the receptacle-side electrically-conductive shell 23 side like this, a plurality of (4) engagement protruding portions 21*d* are provided in the front edge portion of the insulating housing 21 to have certain intervals in the connector longitudinal direction. Each of these engagement protruding portions 21*d* is formed so as to project from the front edge portion of the insulating housing 21 toward the front side. When the receptacle-side electrically-conductive shell 23 is attached to the insulating housing 21, the engagement protruding portions 21*d* are caused to be in the state in which the engagement protruding portions 21*d* are inserted in the above described latch hole portions 23*d* of the receptacle-side electrically-conductive shell 23 side; and, as a result, the members 21 and 23 are prevented from being misaligned from each other in the front-rear/left-right directions, and the receptacle-side electrically-conductive shell 23 is maintained in a fixed state without being lifted up from the insulating housing 21.

[About Intermediate Connecting Portion of Receptacle Connector]

Herein, intermediate connecting portions 23*e* joined with the printed wiring board (illustration omitted) are integrally formed with the above described upper shell plate (first shell plate) 23*a* constituting the upper half part of the receptacle-side electrically-conductive shell 23. The plurality (3) intermediate connecting portions 23*e* are provided along the longitudinal direction of the receptacle-side electrically-conductive shell 23, and the formation positions of the intermediate connecting portions 23*e* in the connector longitudinal direction are set in the parts between the above described latch hole portions 23*d*.

The front-rear-direction formation position at which each of the intermediate connecting portions 23*e* is provided is set in the part between the front end surface (first surface) and the rear end surface (second surface) of the insulating housing 11; and, at a somewhat front-side position with respect to the above described fixed base portion 22*b* of the electrically-conductive contact member (receptacle-side contact member) 22, in other words, at a position close to the front end surface (first surface) of the insulating housing 11 to which the elastic beam portion 22*c* is extending, the intermediate connecting portion 23*e* is bent downward at an approximately right angle and formed in a state in which it is perpendicularly extended downward toward the printed wiring board side.

A lower end part of each of the above described intermediate connecting portion 23*e* is bent at an approximately right angle toward the front side, and a joining leg portion 23*f* flatly extending toward the front side after the bending is configured to be solder-joined with the ground electrically-conductive path formed on the printed wiring board (illustration omitted) in a state in which it is placed thereon from the upper side.

According to the present embodiment provided with such a configuration, when the plug connector 1 serving as the counterpart connector, which is a connection target, is inserted into the receptacle connector 2 according to the present invention, even when the insulating housing 21 and the electrically-conductive shell 23 are deformed, for example, are warped upward along with elastic displacement of the electrically-conductive contact members (receptacle-side contact members) 22 provided in the receptacle connector 2, such deformation is suppressed by the retaining force of the intermediate connecting portions 23*e*. As a result, the contact pressures of the electrically-conductive contact members (receptacle-side contact members) 22 with respect to the plug connector (connection target) 1 are prevented from being reduced.

Moreover, since the number of ground contact-point portions are increased by the provided amount of the intermediate connecting portions 23*e* as described above, an advantage that ground resistance is reduced is obtained.

On the other hand, in the present embodiment, corresponding to the intermediate connecting portions 23*e* provided in the receptacle-side electrically-conductive shell 23, intermediate housing recessed portions 21*c*, which house the intermediate connecting portions 23*e*, are provided in the lower wall portion which forms the mating space 21*b* of the insulating housing 21. The intermediate housing recessed portion 21*c* is formed in a state in which the intermediate housing recessed portion 21*c* is cut out so as to form an approximately rectangular shape in a plane from an edge portion in the front end surface (first surface) side toward the rear end surface (second surface) side of the insulating housing 21.

When the configuration provided with the intermediate housing recessed portions 21*c* like this is employed, the attachment of the receptacle-side electrically-conductive shell 23 with respect to the insulating housing 21 is smoothly carried out without being disrupted by the above described intermediate connecting portions 23*e*.

Moreover, in the present embodiment, also in the above described lower shell plate (second shell plate) 23*b* of the receptacle-side electrically-conductive shell 23, intermediate shell recessed portions 23*g* which house the intermediate connecting portions 23*e* of the receptacle-side electrically-conductive shell 23 are provided. The intermediate shell recessed portion 23*g* is formed in a state in which the intermediate shell recessed portion 23*g* is cut out so as to form an approximately rectangular shape in a plane from an edge of the rear end surface (second surface) side of the lower shell plate (second shell plate) 23*b* of the receptacle-side electrically-conductive shell 23 toward the front end surface (first surface) side, and the intermediate shell recessed portion 23*g* is in a disposition relation to face the above described intermediate housing recessed portion 21*c* in the front-rear direction.

Furthermore, in the rear-end-side edge of the above described lower shell plate (second shell plate) 23*b* of the receptacle-side electrically-conductive shell 23, a plurality of board connecting leg portions 23*j* projecting toward the rear side are provided and are configured to be solder-joined with the printed wiring board when the receptacle connector 2 is mounted.

[About Mating Retaining Member]

Herein, a configuration in which the mutually mated state of the electric connectors 1 and 2 when the plug connector 1 serving as the mating counterpart connector is mated with the receptacle connector 2 is retained by the retaining force of a mating retaining member (mating operating lever) 14 provided in the plug connector 1 is employed. More specifically, when the mating retaining member (mating operating lever) 14 is turned from "mating released position" to "mating working position" in the state in which the plug connector 1 is mated with the receptacle connector 2, the electric connectors 1 and 2 are retained in the mutually mated state without being separated from each other by the external force which is within a certain range. On the other hand, when the plug connector 1 mated with the receptacle connector 2 is to be removed from the receptacle connector 2, the electric connectors land 2 are caused to be in a state in which they can be removed from each other by subjecting the mating retaining member 14 which has been in the "mating working position" to an opening operation and return the mating retaining member 14 to the "mating released position".

More specifically, as shown in FIG. 1 to FIG. 8, the mating retaining member (mating operating lever) 14 is turnably attached to the above described plug-side electrically-conductive shell 13 of the plug connector 1, turning shaft portions 14*a* and 14*a* provided at connector-longitudinal-direction both end parts of the mating retaining member 14 are turnably inserted in a freely mated state in bearing portions 13*d* and 13*d* provided at longitudinal-direction both end parts of the rear end part of the plug-side electrically-conductive shell 13.

The pair of turning shaft portions 14*a* and 14*a* provided in the mating retaining member (mating operating lever) 14 are formed so as to form approximately circular shapes as transverse cross-sectional shapes and extend in the connector longitudinal direction, each of the turning shaft portions 14*a* has a radial-direction uneven part (axis misaligned part) at an intermediate part in the extending direction thereof, and the turning shaft portion 14*a* is configured so that, when biasing force of a spring member (illustration omitted) provided in the bearing portion 13*d* is applied to the uneven part of the turning shaft portion 14*a*, the turning shaft portion 14*a* is retained at the above described "mating released position" and the "mating working position".

Moreover, a pair of coupling arm portions 14*b* and 14*b* are extending from connector-longitudinal-direction both-side outer end parts of the turning shaft portions 14*a* of the mating retaining member (mating operating lever) 14 so as to be bent toward the outer side in a turning radius. The coupling arm portions 14*b* and 14*b* are obliquely extended from the above described turning shaft portions 14*a* and 14*a* so as to approach each other toward the connector central side from the parts immediately after they are extended so as to be bent, and the coupling arm portions 14*b* are then extended so as to be along the turning radius of the mating retaining member 14. Furthermore, at a turning-radius outer end part of the coupling arm portions 14*b* and 14*b*, a turning operating portion 14*c*, which integrally couple turning-side distal end parts of the coupling arm portions 14*b* and 14*b* to each other are extended in a long shape along the connector longitudinal direction.

The entire mating retaining member (mating operating lever) 14 is configured to be turned between the "mating released position" and the "mating working position" when appropriate turning force is applied to part of the turning operating portion 14*c* while that part is held by an assembly operator. When the retaining member 14 which has been at the "mating released position" is subjected to a turning operation to the "mating working position" at a point when the mutual mating between the connectors 1 and 2 is completed, the mutually mated state of the connectors 1 and 2 is maintained.

Furthermore, each of the holddowns 23*c* provided in the receptacle-side electrically-conductive shell 23 of the receptacle connector 2 in the above described manner is provided with a lock portion 23*h*, which is to be mated with the coupling arm portion 14*b* of the mating retaining member (mating operating lever) 14 turned to the above described "mating working position". Each of the lock portions 23*h* is formed by an elastic spring member bulging toward the outer side in the connector longitudinal direction. When the mating retaining member 14 is turned to a vicinity of the "mating working position" after the electric connectors 1 and 2 are mated with each other, the coupling arm portions 14*b* provided in the mating retaining member 14 are moved over the outer bulging portions of the above described lock portions 23*h* of the receptacle connector 2 side, are then moved so as to be elastically displaced toward the connector inner side, are dropped to the lower side of the lock portions 23*h* to cause them to be in an engaged state, and, as a result, the entire mating retaining member 14 is elastically retained at the "mating working position".

Hereinabove, the invention accomplished by the present inventors has been described in detail based on the embodiment. However, the present invention is not limited to the above described embodiment, and it goes without saying that various modifications can be made within a range not departing from the gist thereof.

For example, in the above described embodiment, the intermediate connecting portions 23*e* of the receptacle-side electrically-conductive shell 23 are formed in the front-rear-direction central region of the upper shell plate (first shell plate) 23*a*. However, the intermediate connecting portions 23*e* can be formed so as to extend from the rear edge of the upper shell plate (first shell plate) 23*a* toward the rear side.

Furthermore, the present invention is not limited to connectors for coaxial cables like the above described embodiment, but can be similarly applied also to: for example, a connector for insulating cables; an electric connector of a type in which a plurality of coaxial cables and insulating cables are mixed; an electric connector coupled to a flexible wiring board or the like; a board-to-board connector which mutually connects printed boards; or a connector which directly houses and electrically connects a flexible wiring board in the connector without intervention of a plug connector.

As described above, the present invention can be widely applied to various electric connectors used in various electric devices.

What is claimed is:

1. An electric connector having:

an insulating housing configured to form, in a first surface, an insertion opening to which a connection target is inserted and to house, in mating space, the connection target inserted from the insertion opening toward a second surface opposed to the first surface;

a plurality of contact members attached in the insulating housing; and an electrically-conductive shell attached in a state in which the electrically-conductive shell is covering an outer surface of the insulating housing;

the contact members, each having a fixed base portion retained by the insulating housing, an elastic beam portion extended from the fixed base portion toward the first surface and disposed in an elastically displaceable state in the mating space, and a board connecting portion extended from the fixed base portion toward the second surface and joined with a wiring board; while the insertion opening being formed between a planar surface of a lower wall portion of the insulating housing directly facing the wiring board and a planar surface of an upper wall portion of the insulating housing that is opposed to the lower wall portion in an upper direction apart from the wiring board;

the electrically-conductive shell having a planar surface of a first shell plate covering at least a part of an outer surface of the planar surface of the upper wall portion of the insulating housing opposed to the planar surface of the lower wall portion of the insulating housing facing the wiring board, wherein the first shell plate of the electrically-conductive shell is integrally provided with an intermediate connecting portion joined with the wiring board; and the intermediate connecting portion is formed in a state in which the intermediate connecting portion is extended from a position close to the first surface with respect to the fixed base portion of the contact member toward the wiring board.

2. The electric connector according to claim 1, wherein the intermediate connecting portion is configured to be in a state in which the intermediate connecting portion is joined with a ground electrically-conductive path formed on the wiring board.

3. The electric connector according to claim 1, wherein the intermediate connecting portion is formed in a part between an edge portion forming the first surface of the insulating housing and an edge portion forming the second surface.

4. The electric connector according to claim 3, wherein the insulating housing is provided with a housing recessed portion housing the intermediate connecting portion; and the housing recessed portion is formed in a cut-out state from an edge forming the first surface of the insulating housing toward the second surface.

5. The electric connector according to claim 1, wherein the electrically-conductive shell has a second shell plate that is disposed at the planar surface of the lower wall portion of the insulating housing that faces the wiring board; and, in the second shell plate, a shell recessed portion housing the intermediate connecting portion is formed in a cut-out state from an edge of the second shell plate in a side of the second surface toward the first surface.

* * * * *